US011591805B2

(12) United States Patent
Hannig et al.

(10) Patent No.: US 11,591,805 B2
(45) Date of Patent: Feb. 28, 2023

(54) PANEL

(71) Applicant: AKZENTA PANEELE + PROFILE GMBH, Kaisersesch (DE)

(72) Inventors: Hans-Jürgen Hannig, Bergisch Gladbach (DE); Egon Hoff, Mastershausen (DE)

(73) Assignee: AKZENTA PANEELE + PROFILE GMBH, Kaisersesch (DE)

( * ) Notice: Subject to any disclaimer, the term of this patent is extended or adjusted under 35 U.S.C. 154(b) by 0 days.

(21) Appl. No.: 17/252,536

(22) PCT Filed: Jun. 13, 2019

(86) PCT No.: PCT/EP2019/065463

§ 371 (c)(1),
(2) Date: Dec. 15, 2020

(87) PCT Pub. No.: WO2019/238810

PCT Pub. Date: Dec. 19, 2019

(65) Prior Publication Data

US 2021/0115677 A1 Apr. 22, 2021

(30) Foreign Application Priority Data

Jun. 15, 2018 (EP) ..... 18178061

(51) Int. Cl.
*E04F 15/02* (2006.01)
*E04F 15/10* (2006.01)

(52) U.S. Cl.
CPC ..... *E04F 15/02038* (2013.01); *E04F 15/105* (2013.01); *E04F 2201/0138* (2013.01);
(Continued)

(58) Field of Classification Search
CPC ..... E04F 15/02038; E04F 15/105; E04F 2201/0138; E04F 2201/0161;
(Continued)

(56) References Cited

U.S. PATENT DOCUMENTS 6,006,486 A * 12/1999 Moriau ..... E04F 15/02038 52/592.1
2003/0084636 A1* 5/2003 Pervan ..... E04F 15/04 52/592.1

(Continued)

FOREIGN PATENT DOCUMENTS

CN 2801951 Y 8/2006
CN 201671292 U 12/2010

(Continued)

OTHER PUBLICATIONS

English Translation of the International Preliminary Report on Patentability, dated Dec. 15, 2020, 8 Pages.

(Continued)

*Primary Examiner* — Brent W Herring
(74) *Attorney, Agent, or Firm* — Lucas & Mercanti, LLP; Klaus P. Stoffel

(57) ABSTRACT

A panel having a core, a top side, a bottom side, and edge pairs provided on opposite panel edges. At least one first edge pair has complementary locking elements. One locking element is a locking groove on a groove side of the edge pair and the complementary locking element is a locking tongue on a tongue side of the edge pair. The locking tongue of a first panel can be placed against the locking groove of a second panel of the same kind when the first panel is tilted, and the two panels can be locked to one another interlockingly by a rotating joining movement of the panels relative to one another. The form fit counteracts moving apart of the locked panels specifically in a direction that lies in the plane of the locked panels and is simultaneously perpendicular to the locked panel edges. The locking tongue has, on a top side, a contact surface directed to the panel top side. The top groove wall has a touch surface designed so that when two panels are in the locked state, the touch surface is mated to the contact surface of the tongue top side. At the front of the locking tongue a rounding adjoins the contact surface so that the rounding forms a cross-sectionally round free end of the locking tongue so that a round transition to the tongue
(Continued)

bottom side is created. The rounding of the locking tongue has a radius at least equal to the distal extent of the contact surface.

20 Claims, 4 Drawing Sheets

(52) U.S. Cl.
CPC . *E04F 2201/0161* (2013.01); *E04F 2201/023* (2013.01); *E04F 2201/043* (2013.01)

(58) Field of Classification Search
CPC ..... E04F 2201/023; E04F 2201/043; E04F 13/00894; E04F 2201/03
See application file for complete search history.

(56) References Cited

U.S. PATENT DOCUMENTS

| | | | | |
|---|---|---|---|---|
| 2004/0123547 | A1* | 7/2004 | Grafenauer | E04F 15/02 52/578 |
| 2019/0145108 | A1* | 5/2019 | Hannig | E04F 15/102 52/582.2 |
| 2020/0232226 | A1* | 7/2020 | De Rick | E04F 15/102 |

FOREIGN PATENT DOCUMENTS

| | | | | |
|---|---|---|---|---|
| CN | 103492175 | A | 1/2014 | |
| DE | 10252864 | A1 * | 5/2004 | E04F 15/02 |
| DE | 102013113109 | A1 * | 6/2015 | E04F 15/107 |
| DE | 102013113478 | A1 * | 6/2015 | E04F 15/02038 |
| DE | 202017107016 | U1 * | 11/2017 | E04F 15/02038 |
| EP | 1241303 | A2 | 9/2002 | |
| EP | 1367194 | A2 | 12/2003 | |
| EP | 1922455 | B1 | 12/2014 | |
| EP | 2699416 | B1 | 4/2017 | |
| EP | 3087230 | B1 | 3/2018 | |
| EP | 3524750 | A1 * | 8/2019 | E04F 13/0889 |
| WO | WO-02055810 | A1 * | 7/2002 | E04F 15/02 |
| WO | WO-2004001157 | A1 * | 12/2003 | E04F 15/04 |
| WO | WO-2005118978 | A1 * | 12/2005 | E04F 15/02 |
| WO | 2018087637 | A1 | 5/2018 | |

OTHER PUBLICATIONS

English Translation of Chinese Office Action dated Dec. 1, 2022, 6 Pages.

* cited by examiner

PANEL

The present application is a 371 of International application PCT/EP2019/065463, filed Jun. 13, 2019, which claims priority of EP 18178061.0, filed Jun. 15, 2018, the priority of these applications is hereby claimed and these applications are incorporated herein by reference.

BACKGROUND OF THE INVENTION

The invention concerns a panel comprising a panel core, a panel top side having a utility layer, a panel underside and edge pairs provided in paired relationship at mutually opposite panel edges, wherein at least a first edge pair is provided with complementary locking means, of which one locking means on a groove side of the edge pair is in the form of a locking groove and the complementary locking means on a tongue side of the edge pair is in the form of a locking tongue which fits together in positively locking relationship with the locking groove so that similar panels can be locked to each other, wherein the locking tongue of a first panel with said panel in an inclined position can be fitted to the locking groove of a second similar panel and then the two panels can be locked together in positively locking relationship by a rotational joining movement of the panels relative to each other so that the positively locking engagement which can be achieved counteracts movement of the locked panel edges away from each other, more specifically in a direction which is in the plane of the locked panels and at the same time perpendicular to the locked panel edges, wherein the locking tongue at its tongue top side has a contact surface which is directed towards the panel top side (the surface normal of the contact surface is directed towards the panel top side) and wherein the upper groove wall has a contacting surface which is of such a configuration that in the locked state of two panels it fits together with the contact surface of the tongue top side.

A panel of the general kind set forth is known from EP 3 087 230 B1. Its overall thickness is relatively slight. It can be 2 mm or can be less than an overall thickness of 4 mm. The panel edges of the known panel are of such a configuration that a suitable profiling of the panel edges can be generally produced. The known panel is also provided with a panel core comprising a carrier material which has a matrix material including plastic. A proportion of solid material is provided therein. In a configuration the solid material is a mineral filler, for example talcum.

The invention focuses in particular on the panel core having a carrier material, including a matrix and at least one filler provided therein in the form of particles, wherein the carrier material can have a certain fragility. Preferably the filler is a mineral filler like for example a layer silicate.

The configuration of the known panel has weaknesses, as regards the stability of the panel edges. In the state of the art the free end of the locking tongue has particular weaknesses, in particular it can suffer damage before being laid due to a mechanical force acting thereon from the exterior. In particular if the carrier material has a structure with a certain fragility weaknesses occur in the known panel.

SUMMARY OF THE INVENTION

The object of the invention is to propose a panel which profits from a design configuration of the panel core, that improves stability.

According to the invention that object is attained in that at the front on the locking tongue a rounded portion adjoins the contact surface, the rounded portion forms a free end of round cross-section of the locking tongue, a round transition to the tongue underside is created and the rounded portion of the locking tongue is of a radius equal to or greater than the distal extent of the contact surface.

Preferably the size of the radius of the rounded portion is in a range of 10% to 20% of the overall thickness of the panel, particularly preferably in the range of 10% to 15% of its overall thickness.

The cross-section of the free end of the locking tongue is in the form of a relatively large radius. That measure has improved the stability of that panel edge which is equipped with the locking tongue. Even if the panel core has a carrier material which tends to be fragile the proposed panel is found to be more stable than the state of the art. In particular it is found that, in the case of a panel core comprising a carrier material with a certain fragility, the entire structure is better held together. Without being tied down to this theory it appears to the inventor that a particularity is involved when plate-shaped mineral particles, for example of talcum, are used. Admittedly, in manufacture, the mineral particles are initially randomly embedded in a matrix. In manufacture they are in a granular material. If however a bulk fill of granular material is heated and shaped to form a plate in a continuous process then a certain orientation of the plate-shaped particles appears to occur, more specifically predominantly in a direction parallel to the plane of the plate. That may be due to the fact that a certain orientation of the plate-shaped particles occurs under the action of heat and a certain pressure which is implemented in a direction perpendicular to the plane of the plate.

The invention is preferably intended for panels which are of an overall thickness in the range of 2 to 6 mm, further preferably the overall thickness is between 2.5 and 5 mm and particularly preferably between 2.8 and 4 mm.

Desirably the locking groove has a groove bottom which is of round cross-section and adjoins the contacting surface of the upper groove wall, wherein the groove bottom is of a radius equal to or greater than the distal extent of the contacting surface. Further preferably that groove bottom is so adapted to the front rounded configuration of the locking tongue that in the locked state a small gap remains between the groove bottom and the rounded portion of the locking tongue. That ensures that there is a closed join in the locked state of two panels above the locking tongue.

A further improvement in the panel can be achieved if the contact surface is inclinedly downwardly in the distal direction, and the angle of inclination of the contact surface relative to the horizontal is in a range of 3° to 15°, preferably 5° to 10°, particularly preferably 7° to 9°. The plane of the panel is usually oriented horizontally in the locked state of two panels. The term "horizontal" is intended in accordance with the invention to denote an orientation parallel to the plane or the top side of the panel. The inclination of the contact surface, in particular in the case of a panel core comprising a carrier material which has fragility, can make it possible to achieve better cohesion in the region of the contact surface at the panel surface.

The rounded portion of the locking tongue desirably makes the transition into a contour which is curved outwardly along the tongue underside (convex). The convexly curved contour can be a radius.

It has proven to be particularly useful if the outwardly curved contour of the tongue underside is an outwardly curved radius, the centre point of which is above the panel top side. That measure forms a relatively elongated tongue underside. It cooperates with a lower groove wall which is equally elongated and which has a concave contour adapted to the tongue underside. The curvatures of the tongue underside and the lower groove wall are slight, the area relatively great. The panel edge with the locking tongue in a situation involving a loading on the panel top side profits from a high support force between the tongue underside and the lower groove wall.

Preferably there is a tangential transition from the rounded portion of the free end of the locking tongue into the convex contour of the tongue underside. Dispensing with an angular transition enhances the stability of the panel edge or the panel, at that location.

The locking groove can have a short upper groove wall with a free end and a long lower groove wall, at which an edge bar is distally provided.

It is advantageous if the edge bar has a holding surface and the surface normal of the holding surface faces in the proximal direction. When arranged in that way the holding surface can achieve a good holding force in order to counteract a spreading movement of the panel edges perpendicularly from each other in the plane of the panel (horizontally).

Desirably the locking tongue has a counterpart holding surface provided with a proximally oriented surface normal and the counterpart holding surface in the locked state of two panel cooperates with the holding surface of the edge bar of the lower groove wall. Admittedly the concave contour of the lower groove wall can also rise in the direction of the edge bar and together with the convex contour matching same at the tongue underside can form an overlap which opposes resistance to the panel edges moving away from each other in the above-mentioned horizontal direction, but the horizontal locking action which can be achieved by means of a pronounced holding surface and a matching counterpart holding surface is substantially improved.

It is possible to achieve further advantageous properties if the holding surface of the edge bar and the counterpart holding surface of the locking tongue are arranged parallel to each other in the locked state and are arranged in an angle range of −10° to +10°, preferably −5° to +5° relative to the perpendicular to the panel top side. If the holding surface/counterpart holding surface are in the negative part of the angle range that gives an additional undercut configuration between those two surfaces. By virtue of the additional undercut configuration a locking action is also implemented in a direction perpendicular to the panel plane (vertical). For producing the locking action it is necessary during the joining procedure to afford a certain degree of elastic deformation in the region of the locking means in order to produce the additional undercut configuration and to bring the holding surface into engagement with the counterpart holding surface.

If the holding surface/counterpart holding surface are arranged differently, namely in such a way that they are in the positive part of the angle range, then the locking means can be connected together without elastic deformation and the locked state can be more easily implemented. Then locked panel edges have a locking action only in the horizontal direction. That locking action is then correspondingly better, the smaller the angle of inclination of the perpendicular to the panel surface.

A butting surface is advantageously provided at the free end of the upper groove wall, wherein the panel edge having the locking tongue has above same a counterpart butting surface which, when two panel edges are locked together, cooperates with the butting surface of the upper groove wall. The pairing of the butting surface/counterpart butting surface delimits the joining movement during production of the locking action, that is to say the locking tongue then cannot be moved deeper into the locking groove. At the same time a closed join is formed between the panel edges involved, at the panel top side.

Desirably both the above-mentioned butting surface and also the counterpart butting surface are arranged perpendicularly to the panel plane. If a certain pressing pressure occurs, that presses the butting surface and the counterpart butting surface against each other, then those surfaces can carry the pressing pressure. There is then no risk of the two surfaces slipping relative to each other and a heightwise displacement occurring somewhere at the panel top side. If the arrangement of the pairing of butting surface/counterpart butting surface is arranged inclinedly relative to the perpendicular to the panel plane there would be a risk of a relative displacement of those surfaces, which could have a detrimental effect in the form of a heightwise displacement at the panel top side.

A further advantage is achieved if the lower groove wall has a recess at the transition to the edge bar, wherein the recess transitions into the holding surface of the edge bar. That measure desirably provides that the holding surface can be better used at its lower end. It can for example also extend somewhat more deeply downwardly, into the recess. At least the recess provides a region which is cut free and which in that situation helps to provide that the tongue underside can be unimpededly set down and the counterpart holding surface of the locking tongue can bear in positionally accurate relationship against the holding surface of the edge bar of the lower groove wall.

If the arrangement dispenses with the above-mentioned recess, with which the lower groove wall forms the transition into the holding surface of the edge bar, then alternatively the edge bar can be somewhat higher to enlarge the holding surface upwardly and to impart the desired stability to it.

In addition it is viewed as being advantageous if the panel top side has an edge break or bevel at that panel edge having the locking groove and/or an edge break or bevel at the panel edge having the locking tongue. In that way a panel edge can also be improved in the region of the panel top side because a broken or bevelled edge which for example can be in the form of a radius or chamfer acts as edge protection.

At its top side the locking tongue has a distal extent from the counterpart butting surface to the free end of the locking tongue.

If in addition two locked panel edges have a respective edge break or bevel, for example a respective chamfer, then two edge bevels form a common free space. Beneath the free space the panels touch each other in a plane which can be characterised by a centre line. The common free space can be for example a V-shaped free space (V-shaped join). It is preferred if the width of the common free space is greater than the distal extent of the top side of the locking tongue.

In addition it is considered desirable for the cross-section of the common free space to be in a desirable relationship with the part of the cross-section of the locking tongue, which projects beyond the plane of the above-mentioned centre line. Stated in simple terms the front part of the locking tongue is to be of a cross-section which is approximately equal to the free cross-section of the free space.

More generally the front part of the locking tongue can be of a cross-section which is a certain degree smaller or a certain degree larger than the free cross-section of the free space. The cross-section of the front part of the locking tongue is then to be in the range of 80 to 120% of the size of the cross-section of the free space.

Alternatively the width of the edge break or bevel and/or the depth thereof can be in a range of 5% to 20%, with respect to the total thickness of the panel. In that way the dimensions of the edge break or bevel can be in a relationship to the size of the radius of the rounded portion of the locking tongue; with respect to the overall thickness of the panel there is a certain overlap because the radius is to be in the range of 10% to 20% of the overall thickness.

BRIEF DESCRIPTION OF THE DRAWING

The invention is described in detail hereinafter and illustrated by way of example in a drawing in which.

DETAILED DESCRIPTION OF THE INVENTION

Figure 1:
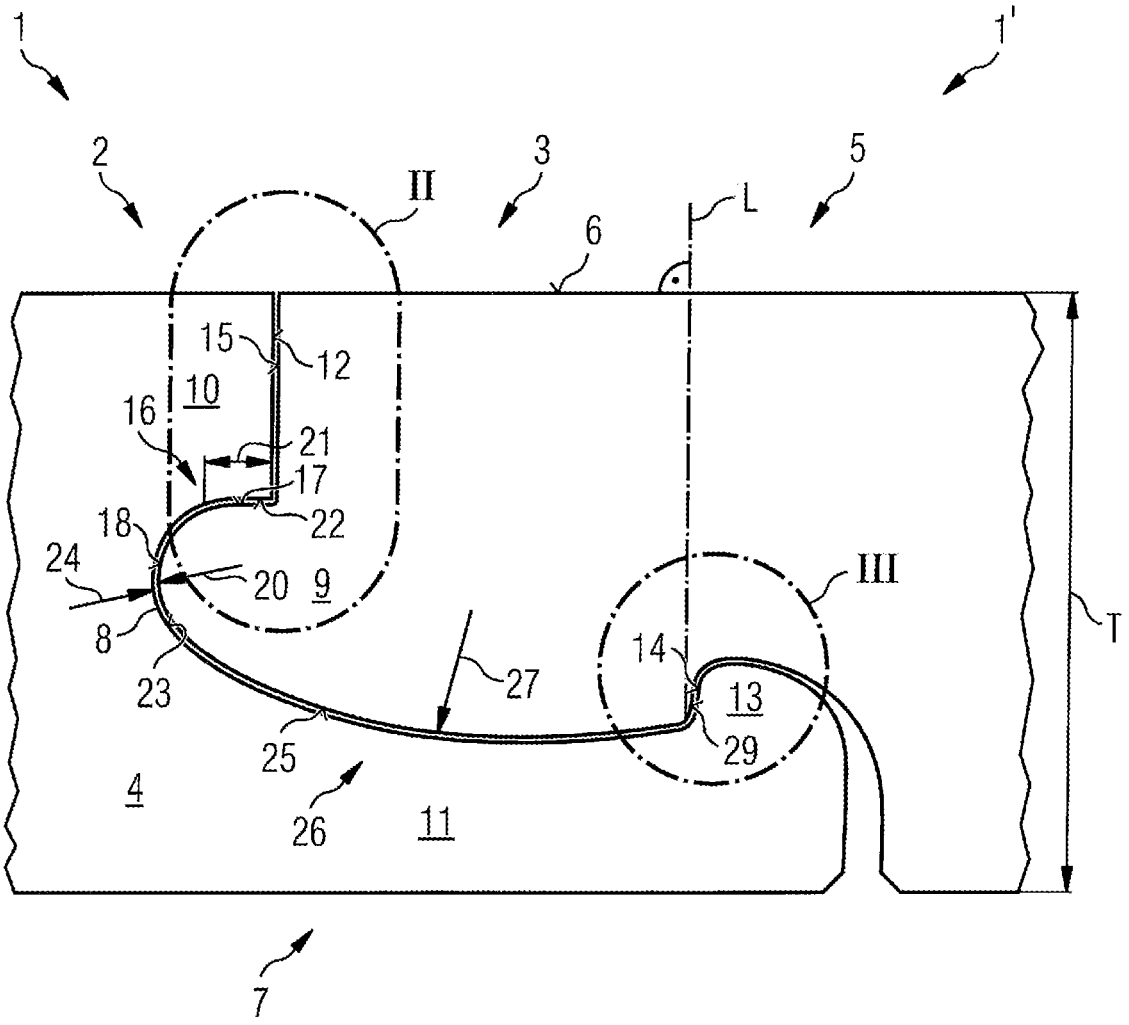
FIG. 1 shows an embodiment of the panel according to the invention.

FIG. 1 shows an embodiment of a panel according to the invention. The panel is shown in divided-up form in order to be able to show its complementary panel edges 1 and 1' and the complementary locking means 2 and 3 thereof in the locked state. It will be appreciated that the panel edges of which portions are shown can also be viewed as a representation of two panels which are not cut through.

In practice it is entirely usual to cut through a panel, for example when the panel at the end of a row of panels is too long. Then it is suitably shortened and cut through for that purpose. The residual piece which is cut off can generally be used to begin a fresh row of panels, in which case the side with the severed surface forms the beginning of the row and a locking means is present at the opposite end to lock a fresh panel thereto. Complementary locking means of a severed panel consequently fit into each other and in principle can be locked together, as can be seen from FIG. 1.

The configuration according to the invention is preferably provided so that claimed panels can be designed with a small overall thickness. The small overall thickness should be possible even when the panel core is of a carrier material which is fragile.

Accordingly the panel shown in FIG. 1 has a panel core 4 comprising a carrier material having a plastic as the matrix material. Provided therein is a proportion of solid material as a filler, namely a mineral filler in the form of talcum. A certain degree of fragility is characteristic of that carrier material by virtue of the filler.

In order to obtain a panel having good stability in spite of that particularity, in particular good stability for the panel edges 2 and 3, they are of a particular configuration.

Basically as shown in FIG. 1 this involves a panel having a panel top side 5 with a utility layer 6, a panel underside 7 and panel edges 1 and 1' which are arranged in opposite relationship in pairs and which form an edge pair. At least the edge pair shown in FIG. 1 has complementary locking means 2 and 3 respectively, with a groove/tongue profile, more specifically on a groove side of the edge pair a locking groove 8 and on a tongue side of the edge pair a locking tongue 9. In the locked state that edge pair acts in positively locking relationship to prevent two panels from moving away from each other perpendicularly to the locked panel edges. At the same time there is a positively locking relationship for locking the panel edges in the vertical direction.

At the groove side the panel has an upper groove wall 10 and a lower groove wall 11. The upper groove wall has a free end, at which there is a flat butting surface 12. The butting surface 12 is arranged perpendicularly to the panel plane.

The lower groove wall 11 is longer than the upper groove wall. It projects in the distal direction further than the upper groove wall. At its free end it is provided with an edge bar 13 having a holding surface 14 which is arranged in the proximal direction, that is to say its surface normal is oriented proximally.

At the tongue side the panel has a locking tongue 9 and above same a counterpart butting surface 15 cooperating with the upper groove wall 10, namely touching the butting surface 12 thereof when the panel edges 1 and 1' are in the locked state.

The locking tongue 7 has a tongue top side 16 having a contact surface 17 oriented towards the panel top side 5. In the FIG. 1 embodiment the contact surface 17 is arranged parallel to the panel top side 5. A rounded portion 18 adjoins the contact surface 17. The rounded portion is of a radius 20 larger than the distal extent 21 of the contact surface 17. In that way the free end of the locking tongue 9 is provided with a comparatively large rounded portion 18 and is thereby more stable than known panels which are more pointed or have corners. In particular it is found that the carrier material holds together better at the free end of the locking tongue 9. The contours are produced by machining working, for example milling.

At the upper groove wall 10 the locking groove 8 has a contacting surface 22 which is arranged parallel to the contact surface 17 and which as shown in FIG. 1 bears against same. The contacting surface 22 transitions into a groove bottom 23 which is of a radius 24 and is adapted to the rounded portion 18 of the locking tongue 9 so that the rounded portion 18 fits into the locking groove 8 and a small gap remains between the rounded portion 15 and the radius 24 of the groove bottom 23, the gap being of the order of magnitude of tenths of a millimetre or fractions thereof.

The large rounded portion 18 at the front on the locking tongue 9 transitions into an outwardly curved (convex) contour 25 forming the tongue underside 26. The convex contour 25 lies on a large radius 27, the centre point of which is far above the panel. The radius 27 is a multiple larger than the overall thickness T of the panel. The contour 25 which is curved in that way of the tongue underside 26 extends far in the proximal direction. At its end the contour 25 goes into a counterpart holding surface 29. The counterpart holding surface has a surface normal in the proximal direction. In the locked state the counterpart holding surface 29 cooperates with the above-mentioned holding surface 14 of the edge bar 13 of the lower groove wall 11. As shown in FIG. 1 the holding surface 14 and the counterpart holding surface 29 are parallel to each other and touch each other. In addition that surface pairing comprising the holding surface/counterpart holding surface is inclined relative to the perpendicular L of the panel top side 5, wherein the angle of inclination α relative to the perpendicular is characterised in accordance with the invention by the sign +/−. In the present case the angle of inclination α in accordance with that definition is +5°.

Figure 2:
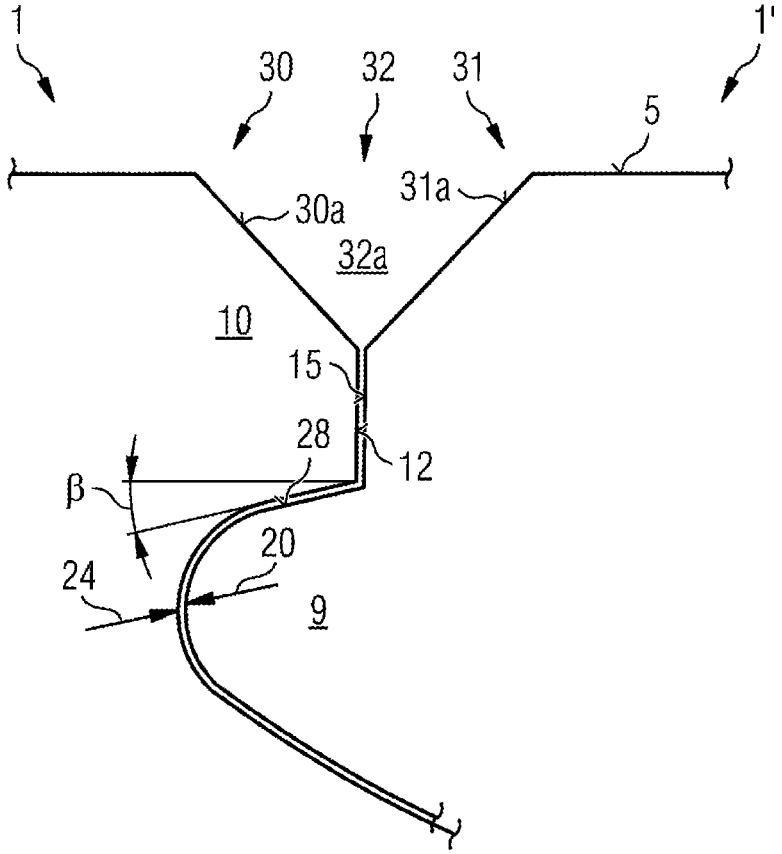
FIG. 2 shows an alternative configuration for the portion in the region of II in FIG. 1.

FIG. 2 shows an alternative configuration for the portion identified by II in FIG. 1. It is possible to see a portion of the locking groove 8 and a portion of the locking tongue 9 which are in the locked state. Provided at the edges of the panel top side 5 is a respective edge break 30 and 31 respectively in the form of a 45° chamfer 30*a* and 31*a*. Together the 45° chamfers form a free space 32 in the form of a V-join 32*a*. In this embodiment the depth of the V-join 32*a* or the depth of the chamfer is 19% of the total thickness T of the panel. It is also possible to see the rounded portion 18 at the free end of the locking tongue 9 which in this embodiment is of a radius 20, the magnitude of which is 12% of the total thickness T of the panel. In addition, unlike the embodiment of FIG. 1, provided at the tongue top side 16 of the locking tongue 9 is a contact surface 28 which is inclined by an angle of inclination β relative to the horizontal.

The angle β here is of a value of 8° so that the contact surface 28 extends downwardly towards the rounded portion 18.

As shown in FIG. 2, illustrated on the locking groove 8 is the upper groove wall 10 which at its free end has a butting surface 12. The butting surface 12 is arranged perpendicularly to the panel top side 5 (vertically). By virtue of the edge break 29 provided above same the butting surface 12 is somewhat smaller than in the FIG. 1 embodiment.

FIGS. 3 to 10 show alternative configurations for that region marked by III in FIG. 1. Each of those alternatives can be provided both as a modification to FIG. 1 and also used jointly with the modification already set out in FIG. 2.

The region III involves the lower groove wall 11 of the locking groove 8 that is provided with the edge bar 13, and the matching contour 25 of the tongue underside 26 of the locking tongue 9.

Figure 3:
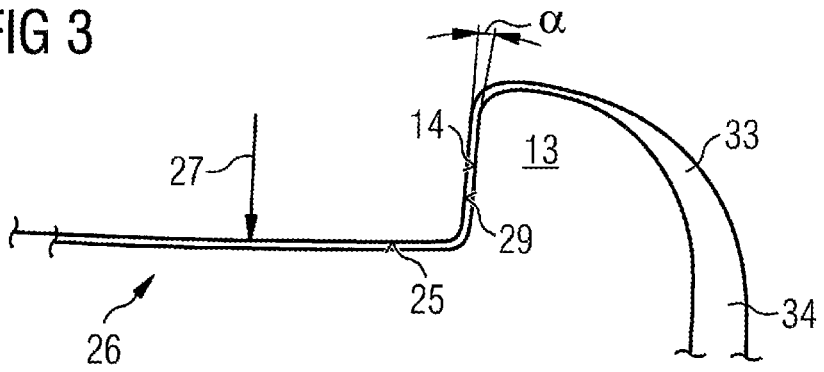
FIG. 3 shows a first alternative configuration for the region marked at III in FIG. 1.

FIG. 3 shows a portion of the lower groove wall 11 with the edge bar 13 which has a proximally arranged holding surface 14, which means that the surface normal of the holding surface 14 is oriented proximally. In this embodiment the holding surface is inclined through +5° relative to the perpendicular L on the panel top side. This embodiment provides for a positively locking engagement to prevent the locked panel edges from moving apart from each other, more specifically in a direction which is in the plane of the locked panels and at the same time perpendicular to the locked panel edges. A locking action to prevent the locked panel edges from moving away from each other perpendicularly to the panel plane (vertically) is not provided in FIG. 3. The contour 25 of the tongue underside 26 is curved outwardly (convexly), wherein the curvature is of a large radius 27 which in the illustrated view appears almost straight. Proximally the contour 25 of the tongue underside 26 goes into a counterpart holding surface 29 which is inclined in matching relationship with the holding surface 14 of the edge bar 13. The pairing consisting of the holding surface/counterpart holding surface is parallel and in contact with each other. The transition between the curved contour 25 of the tongue underside 26 and the counterpart holding surface 29 is provided in the form of a tangential transition of a small radius.

At its upper end the edge bar 13 is bent downwardly in the distal direction. In that region the locking tongue 9 has a recess 33 which is larger than the edge bar 13. A gap 34 (clearance) is provided in the distal direction between the edge bar 13 and the recess 33. The contour of the recess 33 is also curved to match the edge bar 13. That arcuate configuration of the edge bar 13 and the recess 33 in turn benefit the stability, in particular when the panel core comprises a carrier material with a certain degree of fragility, the structure is better held together and less breakage occurs.

Figure 4:
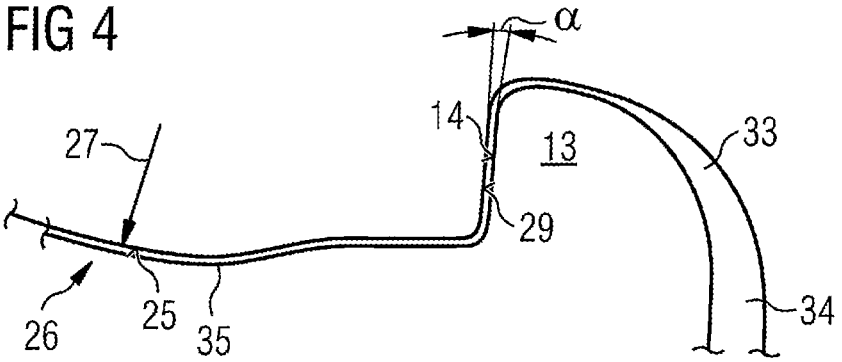
FIG. 4 shows a second alternative configuration for the region marked at III in FIG. 1.

FIG. 4 shows an alternative configuration which is based on FIG. 3 to which reference is directed. It differs by virtue of a modified contour 25 of the outwardly curved tongue underside 26 and the matching contour of the lower groove wall 11. More specifically the lower groove wall 11 has a low point 35 and from there a certain (slight) rise in the distal direction. That configuration is preferred if a contact surface at the top side of the locking tongue 9 has an inclination, as in the example of FIG. 2 the contact surface 28, in which case the edge bevel provided in FIG. 2 is not important. If the panels move away from each other with a certain degree of elastic deformation the above-mentioned rise in the contour of the lower groove wall 11 can provide that the locking tongue 9 slides along the rise. At the same time the contact surface 28 provided upwardly on the locking tongue 9 can slide along a complementary contacting surface 22 of the upper groove wall 10 because same has an angle of inclination β which is approximately parallel to the rise in the contour of the lower groove wall 11.

Figure 5:
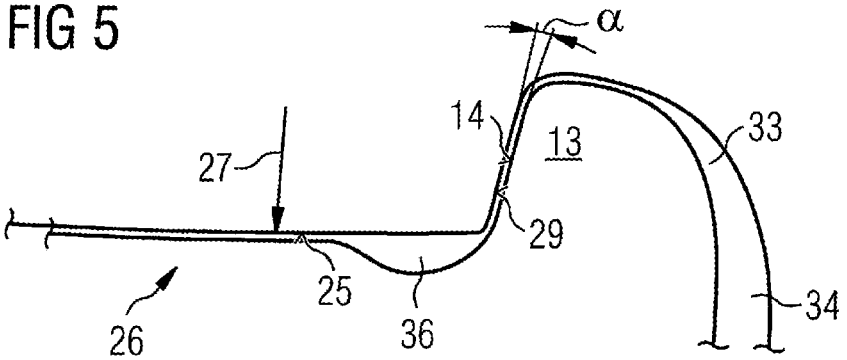
FIG. 5 shows a third alternative configuration for the region marked at III in FIG. 1.

The embodiment in FIG. 5 is based on that shown in FIG. 3. Unlike FIG. 3 however the lower groove wall 11 at the transition to the edge bar 13 has a recess 36 which transitions into the holding surface 14 of the edge bar 13. The recess 36 is of a channel-shaped configuration of round cross-section, which serves for stability.

Figure 6:
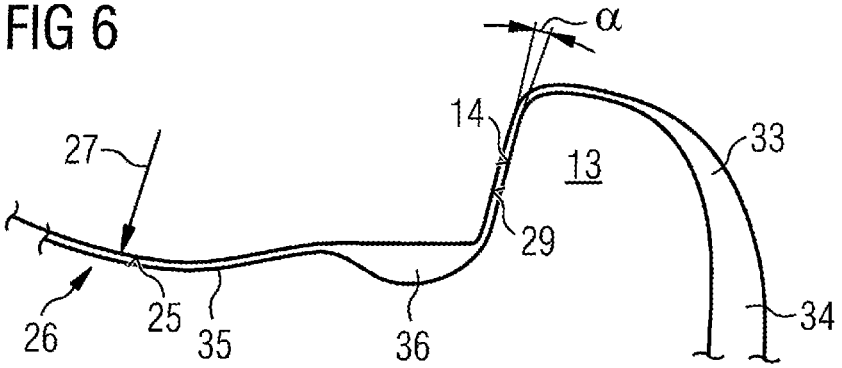
FIG. 6 shows a fourth alternative configuration for the region marked at III in FIG. 1.

FIG. 6 shows an alternative configuration based on FIG. 5 to which reference is directed. It differs by virtue of a modified contour 25 of the outwardly curved tongue underside 26 and the matching contour of the lower groove wall 11. More specifically those contours are of such a configuration as shown above in FIG. 4, that is to say the lower groove wall has a low point 35. From the low point 35 in the distal direction there is a certain (slight) rise towards the edge bar 13. That configuration is preferably used in combination with an inclined contact surface 28 as in the FIG. 2 example at the tongue top side 16 of the locking tongue 9, more specifically for the same reasons as stated above.

Figure 7:
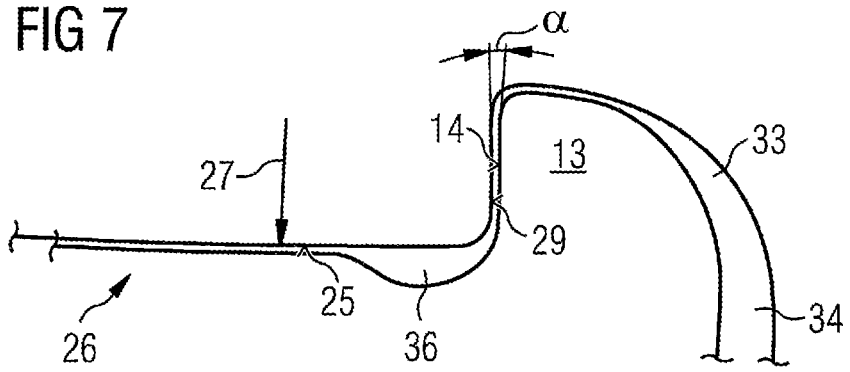
FIG. 7 shows a fifth alternative configuration for the region marked at III in FIG. 1.

The embodiment in FIG. 7 is based on the FIG. 5 embodiment. It differs by virtue of the configuration of the edge bar 13 which now has a proximal holding surface 14 which again is inclined relative to the perpendicular L to the panel top side 5, but in the opposite direction compared to FIG. 5, which in the present embodiment signifies an angle of inclination α of −5°. The locking tongue 9 has a proximal counterpart holding surface 29 which in the locked state is arranged parallel to the holding surface 14 of the edge bar 13 and touches same in surface relationship.

When the pairing comprising the holding surface/counterpart holding surface is arranged with an angle of inclination α of −5° then between the two surfaces of that pair there is an additional undercut configuration which also provides a locking action in a direction perpendicular to the panel plane (vertically). To bring that undercut configuration into engagement a certain elastic deformation in the region of the locking means 2 and 3 is required, during the joining procedure.

Figure 8:
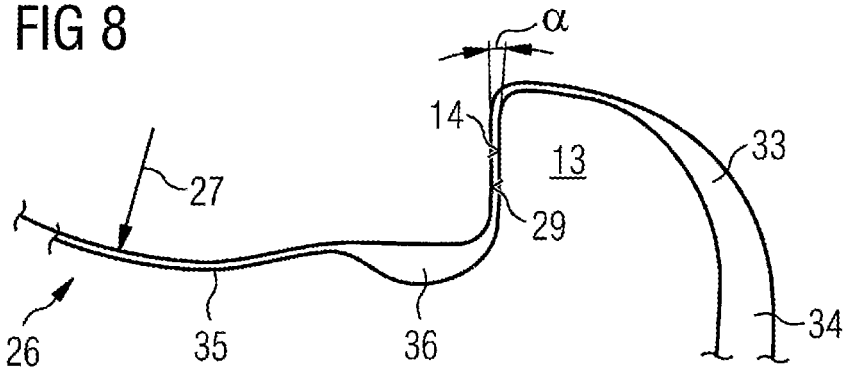
FIG. 8 shows a sixth alternative configuration for the region marked at III in FIG. 1.

FIG. 8 shows an embodiment whose holding surface/counterpart holding surface are identical to FIG. 7 with the angle of inclination α of −5° so that it can provide a locking action perpendicularly to the panel plane (vertically). In addition the contour 25 of the outwardly curved tongue underside 26 and the matching contour of the lower groove wall 11 are altered, more specifically as above in FIGS. 4 and 5, that is to say the lower groove wall 11 has a low point 35 and from there in the distal direction a certain (slight) rise towards the edge bar 13. That configuration is again preferably used in combination with an inclined contact surface at the top side of the locking tongue, as in FIG. 2 being the contact surface 28. It gives the same advantage as described hereinbefore with reference to FIG. 4. Furthermore the lower groove wall 11 is provided with a channel-shaped recess 36 as in FIG. 5, to which reference is directed.

Figure 9:
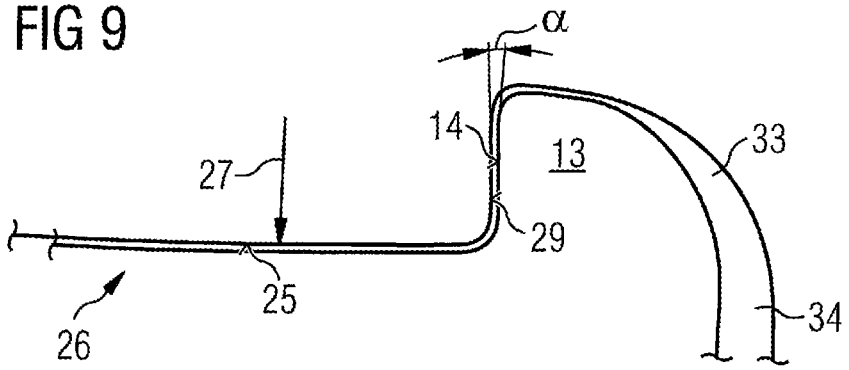
FIG. 9 shows a seventh alternative configuration for the region marked at III in FIG. 1.

FIG. 9 shows an embodiment whose holding surface/counterpart holding surface are identical to FIG. 7 with an angle of inclination α of −5° so that it can provide a locking action perpendicularly to the panel plane (vertically). Unlike FIG. 7 however this arrangement dispenses with a channel-shaped recess 36 in the lower groove wall 11.

Figure 10:
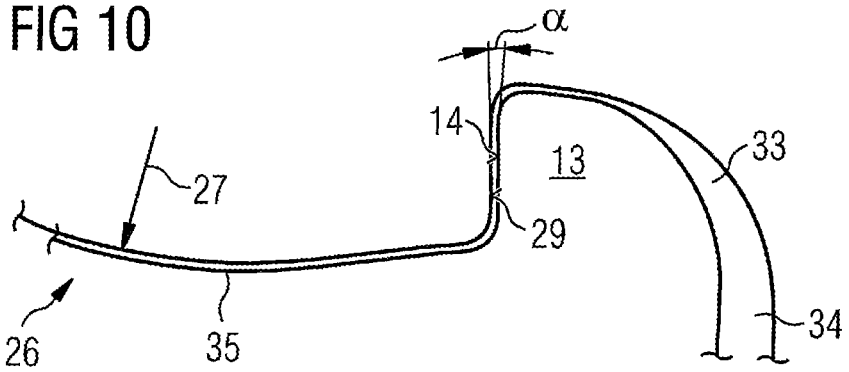
FIG. 10 shows an eighth alternative configuration for the region marked at III in FIG. 1.

FIG. 10 shows a further embodiment with a holding surface/counterpart holding surface arranged at an angle of inclination α of −5° so that they provide a locking action perpendicularly to the panel plane (vertically), in that respect FIG. 10 is identical to FIGS. 7, 8 and 9. It differs however in respect of the contour 25 of the outwardly curved tongue underside 26 and the matching contour of the lower groove wall 11 which has a low point 35 and which from there has a certain (slight) rise in the distal direction towards the edge bar 13.

LIST OF REFERENCES

1 panel edge
1' panel edge
2 locking means
3 locking means
4 panel core
5 panel top side
6 utility layer
7 panel underside
8 locking groove
9 locking tongue
10 upper groove wall
11 lower groove wall
12 butting surface (upper groove wall)
13 edge bar
14 holding surface (edge bar)
15 counterpart butting surface
16 tongue top side
17 contact surface
18 rounded portion
20 radius
21 extent (contact surface)
22 contacting surface
23 groove bottom
24 radius
25 convex contour (tongue underside)
26 tongue underside
27 radius (tongue underside)
28 contact surface
29 counterpart holding surface (tongue underside)
30 edge break
30*a* 45° chamfer
31 edge break
31*a* 45° chamfer
32 free space
32*a* V-join
33 recess
34 gap
35 low point
36 recess
L perpendicular
T total thickness
α angle of inclination (edge bar)
β angle of inclination (contact surface)

The invention claimed is:

1. A panel comprising a panel core, a panel top side having a utility layer, a panel underside and edge pairs provided in paired relationship at mutually opposite panel edges, wherein at least a first edge pair is provided with complementary locking means, of which one locking means on a groove side of the edge pair is in the form of a locking groove and the complementary locking means on a tongue side of the edge pair is in the form of a locking tongue which fits together in positively locking relationship with the locking groove so that similar panels can be locked to each other, wherein the locking tongue of a first panel with said panel in an inclined position can be fitted to the locking groove of a second similar panel and then the two panels can be locked together in positively locking relationship by a rotational joining movement of the panels relative to each other so that the positively locking engagement which can be achieved counteracts movement of the locked panel edges away from each other, more specifically in a direction which is in the plane of the locked panels and at the same time perpendicular to the locked panel edges, wherein the locking tongue at its tongue top side has a contact surface which is directed towards the panel top side and wherein the upper groove wall has a contacting surface which is of such a configuration that in the locked state of two panels it fits together with the contact surface of the tongue top side, wherein at the front on the locking tongue a rounded portion adjoins the contact surface, the rounded portion forms a free end of round cross-section of the locking tongue, a continuous round transition between the tongue underside and the contact surface is created and the rounded portion of the locking tongue is of a radius equal to or greater than the distal extent of the contact surface, wherein the radius of the rounded portion is 12% of a thickness of the panel.

2. The panel according to claim 1 wherein its overall thickness is in the range of 2 to 6 mm.

3. The panel according to claim 2, wherein its overall thickness is in the range of 2.5 to 5 mm.

4. The panel according to claim 3, wherein its overall thickness is in the range of 2.8 to 4 mm.

5. The panel according to claim 1 wherein the locking groove has a groove bottom which is of round cross-section and which adjoins the contacting surface of the upper groove wall and the groove bottom of the locking groove is of a radius equal to or greater than the distal extent of the contacting surface.

6. The panel according to claim 1 wherein the contact surface is inclinedly downwardly in the distal direction, and the angle of inclination of the contact surface relative to the horizontal is in a range of 3° to 15°.

7. The panel according to claim 6, wherein the angle of inclination of the contact surface relative to the horizontal is in a range of 5° to 10°.

8. The panel according to claim 7, wherein the angle of inclination of the contact surface relative to the horizontal is in a range of 7° to 9°.

9. The panel according to claim 1 wherein the rounded portion of the locking tongue transitions into an outwardly curved contour extending along the tongue underside.

10. The panel according to claim 9 wherein the outwardly curved contour of the tongue underside is an outwardly curved radius, the center point of which is above the panel top side.

11. The panel according to claim 9, wherein there is a tangential transition from the rounded portion into the convex contour of the tongue underside.

12. The panel according to claim 1 wherein the locking groove has a short upper groove wall having a free end and a long lower groove wall at which an edge bar is distally provided.

13. The panel according to claim 12 wherein the edge bar has a holding surface with a surface normal that faces in a proximal direction toward the main body of the panel.

14. The panel according to claim 13, wherein the locking tongue has a counterpart holding surface provided with a proximally oriented surface normal and the counterpart holding surface in the locked state of two panel cooperates with the holding surface of the edge bar of the lower groove wall.

15. The panel according to claim 13 wherein the holding surface of the edge bar and the counterpart holding surface of the locking tongue are arranged parallel to each other in the locked state and are arranged in an angle range of −10° to +10° relative to the perpendicular to the panel top side.

16. The panel according to claim 15, wherein the holding surface of the edge bar and the counterpart holding surface of the locking tongue are arranged in an angle range of −5° to +5° relative to the perpendicular to the panel top side.

17. The panel according to claim 12 wherein the lower groove wall has a recess at the transition to the edge bar and the recess transitions into the holding surface of the edge bar.

18. The panel according to claim 1 wherein a butting surface is provided at the free end of the upper groove wall, the panel edge with the locking tongue has above same a counterpart butting surface which when two panel edges are locked to each other cooperates with the butting surface of the upper groove wall.

19. The panel according to claim 1 wherein at the panel edge with the locking groove the panel top side has an edge break and/or at the panel edge with the locking tongue it has an edge break.

20. The panel according to claim 1 wherein the locking tongue extends in the distal direction beyond the counterpart butting surface and both panel edges have edge breaks which form a free space in the locked state.

* * * * *